US005881975A

United States Patent [19]

Bianco

[11] Patent Number: 5,881,975

[45] Date of Patent: Mar. 16, 1999

[54] HAMPER

[76] Inventor: Jeanine M. Bianco, 265 Fair Oaks St., San Fransisco, Calif. 94110

[21] Appl. No.: 880,197

[22] Filed: Jun. 23, 1997

[51] Int. Cl.[6] ..... B65B 67/12

[52] U.S. Cl. ..... 248/95; 383/22

[58] Field of Search ..... 248/95, 97, 99, 248/100, 128, 146, 153; 383/34.1, 22, 24; 220/404

[56] References Cited

U.S. PATENT DOCUMENTS

| | | | |
|---|---|---|---|
| D. 279,038 | 5/1985 | Thompson | D32/37 |
| D. 290,538 | 6/1987 | Basore | D32/37 |
| 1,378,050 | 5/1921 | Morris | 248/99 |
| 2,468,897 | 5/1949 | Rothe | 383/22 |
| 2,740,445 | 4/1956 | Fornell | 383/22 |
| 2,873,782 | 2/1959 | Gunn | 150/48 |
| 4,267,996 | 5/1981 | Turcott | 248/97 |
| 4,364,425 | 12/1982 | Mainville | 294/68.21 |
| 4,413,800 | 11/1983 | Kelson | 248/99 |
| 4,603,432 | 7/1986 | Marino | 383/2 |
| 4,646,802 | 3/1987 | Basoke | 150/49 |
| 4,964,118 | 10/1990 | Hastings | 248/97 |
| 5,305,907 | 4/1994 | Richardson | 220/400 |
| 5,507,577 | 4/1996 | Fowler | 383/7 |
| 5,544,781 | 8/1996 | Mattesky | 220/404 |
| 5,645,353 | 7/1997 | Linnell et al. | 383/22 |

*Primary Examiner*—Ramon O. Ramirez
*Assistant Examiner*—Anita King
*Attorney, Agent, or Firm*—Roland H. Shubert

[57] ABSTRACT

A generally rectangular hamper bag having an external frame that includes a base and four vertically upstanding leg members. The four leg members are of equal height and terminate at their upper ends in a finial or a closed loop. The hamper bag is secured to each leg member either at locations near or at the bottom and top of the leg members using grommets, webbing, or similar fasteners or through a stiffening member disposed in a channel around the bag perimeter near the bag top.

18 Claims, 7 Drawing Sheets

HAMPER

TECHNICAL FIELD

This invention relates to a hamper for storing and transporting articles.

More particularly, this invention relates to a hamper that includes a fabric bag supported with a rigid frame.

In one specific embodiment, this invention relates to a hamper that performs a utilitarian function of storing soiled laundry while adding a decorative feature to the furnishings of a home.

In other specific embodiments, the hamper of this invention may be used as a rack to store magazines and other periodicals, as a waste basket, as a boutique tissue holder, or may be used as a decorative receptacle to store similar household items.

BACKGROUND ART

Hampers in general, and laundry hampers in particular, are available in a great variety of types and designs. One type of hamper comprises a container, often constructed of wicker or plastic, that forms a storage chamber for soiled clothing. Such hampers ordinarily have a top closure or cover that is hinged to the container and serves to shut the container when it is not in use. Soiled clothing that has accumulated within the hamper is periodically transferred to a basket or other transport means which is then carried to the washing machine or other laundry facility. An example of a clothes hamper of that type is illustrated in U.S. Pat. No. 2,873,782.

Another type of hamper consists of a fabric bag that is supported upon a frame or stand. The frame may consist of a pair of stanchions, interconnected at the bottom, and having cross arms at the stanchion top to support a fabric bag such as is shown in Design U.S. Pat. No. 290,538. Other hampers employ support rods that extend vertically from the corners of a rectangular base. A fabric bag is held in an open, upright position by folding the top of the bag over the ends of the support rods. Other hampers employ a support frame arranged as a pair of scissor-type linkages arranged with cross arms at the frame top to support a fabric laundry bag in an upright and open attitude. Examples of such hamper arrangements are shown in U.S. Pat. Nos. 4,646,802 and 5,507,577.

SUMMARY OF THE INVENTION

This invention provides a hamper bag and frame stand that is utilitarian but also serves as a decorative accessory item. In one preferred embodiment, a hamper bag is supported in an upright position by a frame having a base and four vertically upstanding leg members. In this embodiment, the frame is formed of a pair of U-shaped elements, each having a base member and two leg members. The leg members are disposed parallel one to the other at right angles to the base, and the two base members are joined at their mid-points so that the leg members are oriented in a vertically upstanding attitude. A hamper bag having a rectangular flat bottom, vertical sides and a top is secured within the frame using two sets of fastening means. A first set of fastening means is located near the bottom of the bag, and consists of a tie or other detachable fastening means that extends from each intersection of two bag sides, or bag corners, to a neighboring frame leg member. A second set of fastening means is located near the bag top, and may consist of a loop, grommet, or tie that extends from each intersection of two bag sides to the top of the neighboring leg member. A second embodiment of this invention employs the same frame as does the first, but attaches the hamper bag to the frame through a stiffening member arranged to fit within a channel sewn around the perimeter of the open bag near the bag top. The stiffening member, in turn, is secured to the frame leg members by means of fasteners such as screws that pass through the stiffening member.

Hence, it is an object of this invention to provide a hamper bag and a frame from which the bag may be quickly detached.

It is a further object of this invention to provide a hamper having a visible frame that serves also to showcase the fabric from which the bag is formed.

It is yet another object of this invention to allow the same structure to be used either as a laundry hamper, as a boutique tissue holder, or as a receptacle for other items.

Other objects and advantages of the invention will be apparent from the following detailed disclosure.

DESCRIPTION OF THE PREFERRED EMBODIMENTS

Figure 1:
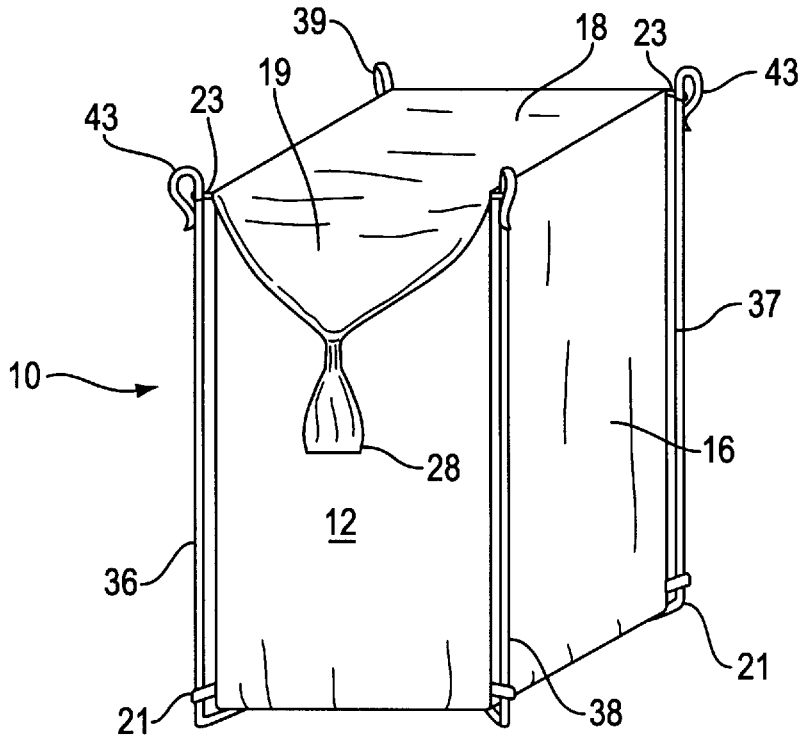
FIG. 1 is a perspective view showing a first embodiment of the hamper bag and supporting frame therefor, according to the present invention.

This invention provides a multi-purpose hamper bag and frame that, while utilitarian, can also serve as a fashion accent to a room. Referring first to FIG. 1, a preferred embodiment of the hamper bag and frame of this invention is indicated generally by the reference numeral 10. A hamper bag 12, made of a flexible fabric material, is supported in an upright position by attachment to the vertically extending leg members 36, 37, 38, and 39 of an exterior frame. A wide variety of fabrics are appropriate to use in making the hamper bag of this invention depending upon the decorative effect that is desired. For example, were it desired to project a luxurious look, then suitable fabrics might include ottoman, brocade, velveteen and moire. Were a fun or sporty look desired, then canvas, denim or even mattress ticking can be used.

Figure 3A:
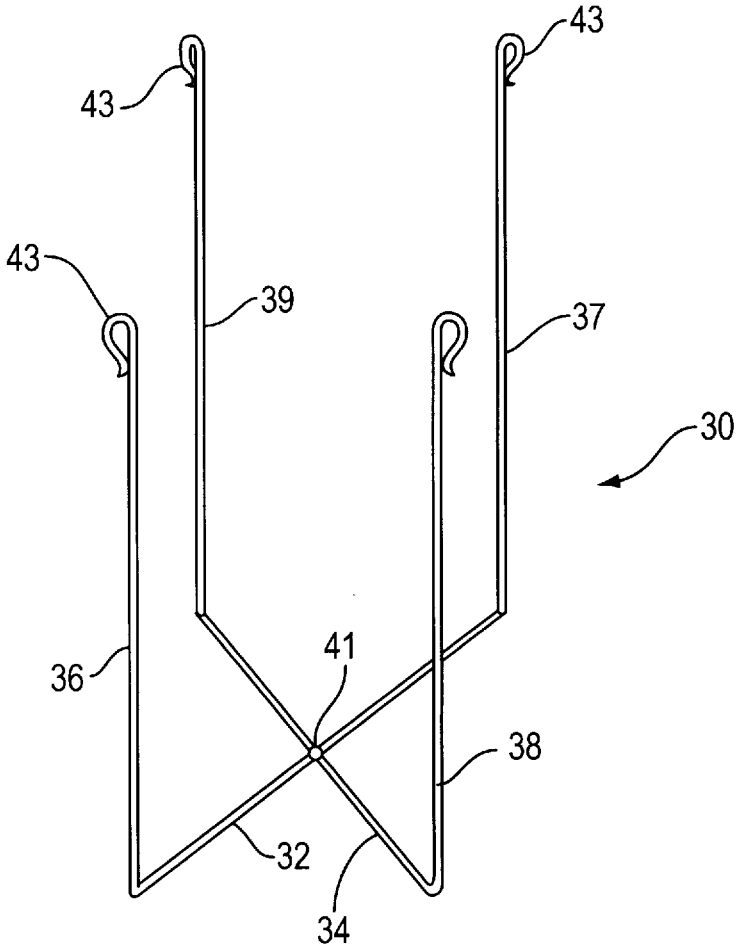
FIG. 3A is a perspective view of the supporting frame with the hamper bag removed therefrom.
Figure 3B:
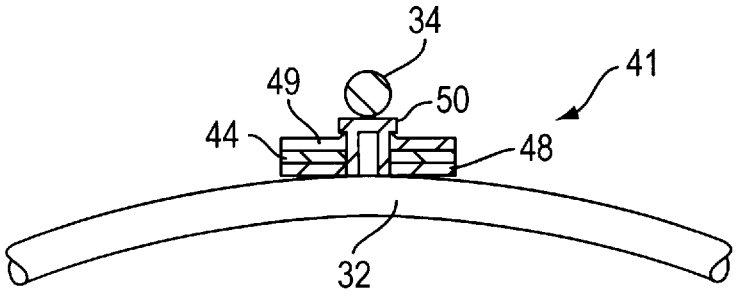
FIG. 3B is a detail of the joining means of FIG. 3A in partial section.

Frame 30 is shown in more detail in FIG. 3A. It consists of two generally symmetrical U-shaped elements, each having a base member 32 and 34 respectively. Each base member has a pair of vertically upstanding leg members, 36 and 37, and 38 and 39 respectively. The two base members are joined together at their respective mid-points by means of securing means 41. Securing means 41 may usefully be a bolt, screw or clamp, but the arrangement shown in FIG. 3B is preferred. In the embodiment of FIG. 3B, securing means 41 comprises a first circular flange or washer 44 that is secured to frame base member 32 by means of weld 48 or other suitable joining means. A second circular flange or washer 49 is held in place atop washer 44 by means of rivet 50 which is fixed to washer 44 and frame base member 32. Washer 49, in turn, is fixed to the second base member 34, and is free to rotate relative to washer 44.

It is preferred that frame base member 32, and frame base member 34 as well, be slightly curved so that the center of each base member is higher than is the member ends. The degree of curvature of member 34 must be somewhat greater than that of member 32 so that the ends of both base members lie on the same plane, thus providing firm support for frame 30 as it rests on a floor or other flat surface. In most instances, it is preferred that the two frame members be substantially identical one to another. However, base members 32 and 34 may be of different lengths to accommodate a hamper bag of rectangular, rather than square cross-section. Whether or not the base members are of equal length, it is necessary that all leg members be of the same height.

Figure 4:
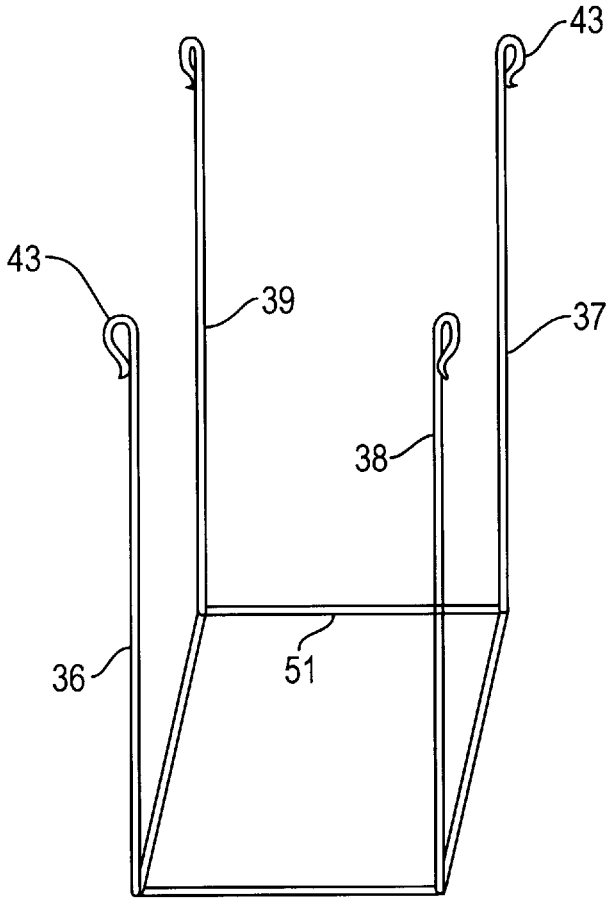
FIG. 4 is a perspective view of another embodiment of the supporting frame with the hamper bag removed therefrom.

An alternative arrangement of the supporting frame 30 is shown in FIG. 4. Here, the frame consists of a rectangular, preferably square, base member 51 having four vertically upstanding leg members, 36, 37, 38, and 39. The leg members are attached to base member 51, one at each base corner. The leg members are all of equal height, and are disposed parallel one to another.

It is preferred that the frame of either FIG. 3A or FIG. 4 be constructed of metal so as to provide sufficient strength to securely support the hamper bag, and the frame may conveniently be fabricated from metal strapping or tube stock. Appropriate metals for use in the frame include steel, wrought iron, copper, brass and aluminum. Because the frame is external to the hamper bag, the appearance and finish of the frame may be selected to serve as an accent to the fabric that is chosen for the hamper bag.

Figure 2:
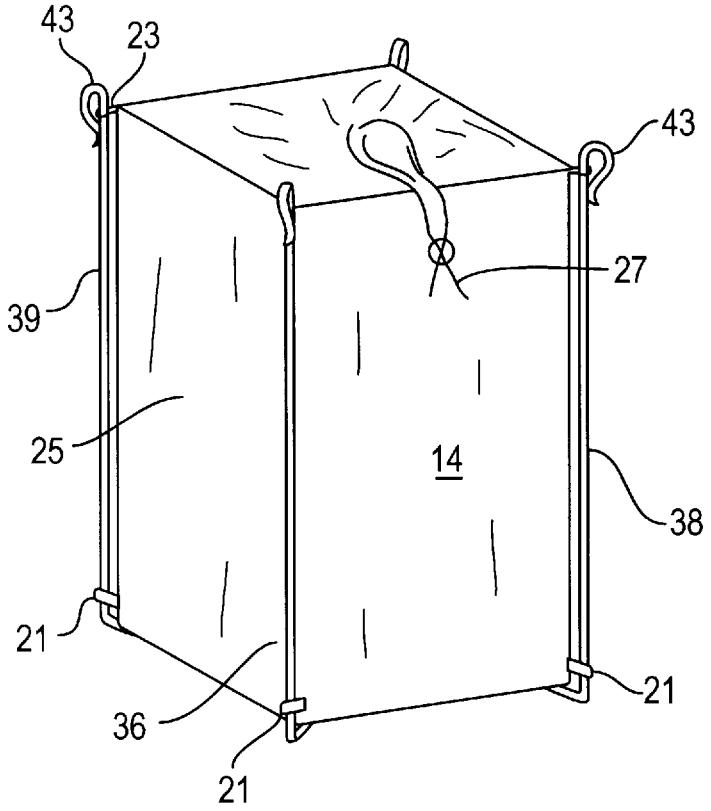
FIG. 2 is a perspective view showing another embodiment of the hamper bag and frame.

FIG. 2 shows another embodiment of the hamper bag and frame in which bag 14 differs from bag 12 of FIG. 1 in the arrangement of the bag top. Referring now to FIGS. 1 and 2 together, both bags 12 and 14 are sized and shaped to fit inside the upstanding frame leg members, and each is suitably shaped as a rectangular body. The bag body itself may be formed of fabric panels that are sewn or otherwise joined at intersecting sides and sewn to a bag bottom as well. The bag bottom may be made of a heavy canvas or similar material, and is rectangular, preferably square, in shape.

Figure 5:
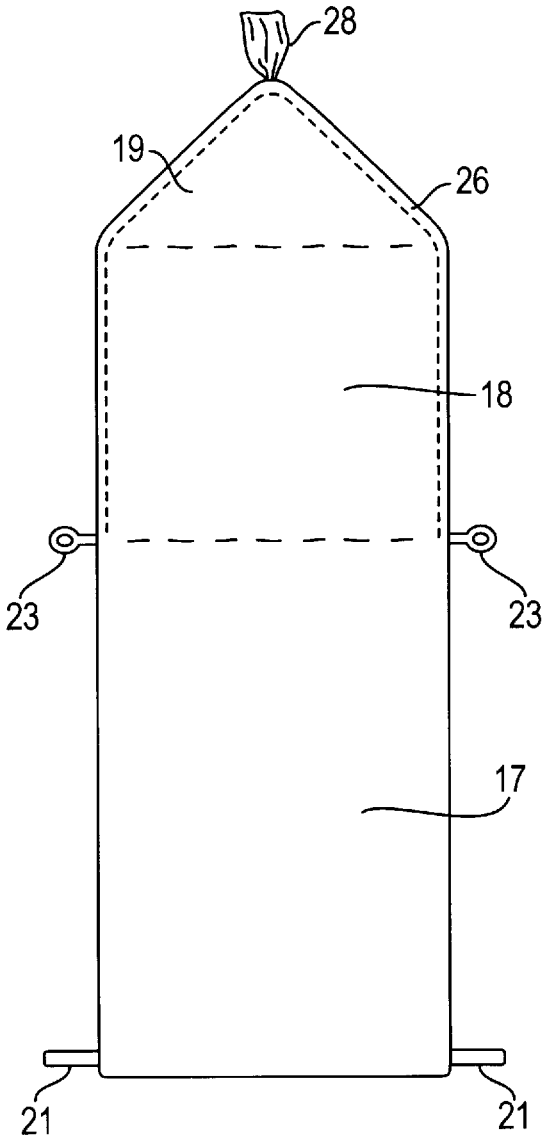
FIG. 5 is a rear view of the hamper bag of FIG. 1 with the top and flap extended upwardly.

The hamper bag of FIG. 1 is shown in different view in FIG. 5. Referring now to both FIGS. 1 and 5, bag 12 is formed of a front panel 15, two identical side panels 16, and a rear panel 17 (FIG. 5) that may be extended to form a bag top 18 having a front flap 19. Flap 19 may comprise a triangular extension of the bag top 18 as is shown in FIG. 1. In a preferred embodiment wherein the bag bottom is square, front panel 15, rear panel 17 and side panels 16 may be identical. In this embodiment, a bag top 18 may be attached to the top of the rear panel 17 as by sewing. Detachable fastening means 21 are provided at each corner, or intersection of two bag sides, at a location adjacent to the bottom of the bag. Each fastening means 21, four in all, comprises a loop or a tie that is arranged to secure the bag to a neighboring frame leg member. Means 21 may simply comprise a length of fabric webbing or band, or pair of bands, that can be looped around and tied to a leg member. Alternatively, means 21 may include a snap fastener, a Velcro® fastener, or any other type of fastener that can function to secure the strap around the frame leg member.

Additional, or second, fastening means 23 are provided at each corner, or intersection of two bag sides, near the bag top at the height of the frame leg member tops. These second fastening means 23 may be identical to fastening means 21, or may comprise a generally circular loop or grommet that is arranged to engage the top of a frame leg member. The two sets of fastening means 21 and 23, when secured to the frame leg members, hold the hamper bag in an upright and generally open position.

Figure 6:
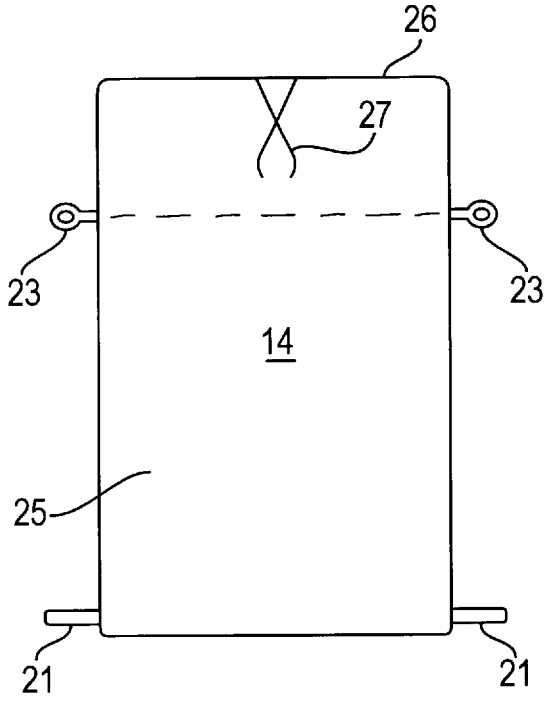
FIG. 6 is a front view of the hamper bag of FIG. 2.

The hamper bag 14 of FIG. 2 is shown in different view in FIG. 6. Referring now to both FIGS. 2 and 6, hamper bag 14 is of similar construction to that of bag 12, and is made from four rectangular panels 25 that are identical in size and shape. The sides of each two adjacent panels are sewn together to form a bag corner, and the bottom end of the panel is sewn to the bag bottom. The top end of each panel is turned and sewn to form a channel 26 through which a drawstring 27 is passed. If desired, a decorative tassel or other ornamentation 28 (FIG. 1) may be attached to the drawstring ends. As with the hamper bag 12 of FIG. 1, all of the panels may be the same fabric, or adjacent panels may employ fabrics that complement or accent the other.

Bag 14 is attached to frame 30 in the same manner as was described in connection with bag 12, utilizing fastening means 21 and 23. However, in this embodiment it is preferred to attach upper fastening means 23 to bag 14 at a location below the bag top, allowing a sufficient length of panel to extend above means 23 so that the bag top can be drawn closed while in the frame. That arrangement is illustrated in FIG. 2. In order to accomplish that, the interval below the bag top at which means 23 are attached may be made equal to approximately half the distance between adjacent leg members.

Figure 7:
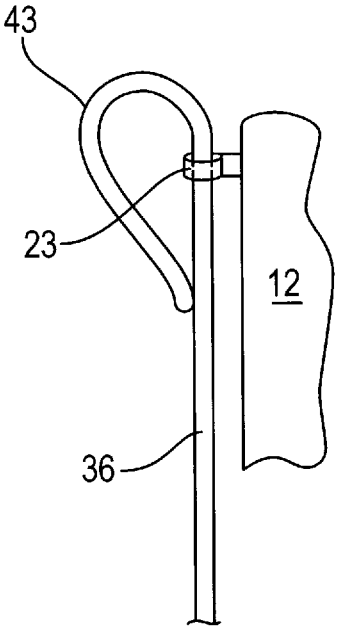
FIG. 7 is a detail view of a frame leg member end showing one arrangement for securing the hamper bag to the frame.

The type of fastening means 23 that is selected to secure the hamper bag to the frame depends in some measure upon the form of the leg member termination. As is shown in FIG. 7, the top end of a leg member 36 may be rebent downwardly to form a closed loop 43. Forming the leg member end as a loop is particularly preferred in those instances where the frame elements are fabricated from metal strapping. In this embodiment, fastening means 23 preferably comprise a band, or pair of bands, that can be passed through loop 43 and tied or otherwise secured to thereby hold the hamper bag in an upright position.

Figure 8:
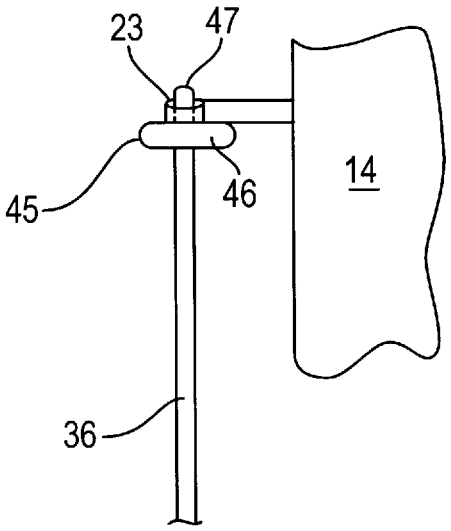
FIG. 8 is a detail view of a frame leg member end showing another arrangement for securing the hamper bag to the frame.

FIG. 8 illustrates a form of leg member termination that is particularly preferred in those embodiments of the invention in which the frame elements are formed from metal tubing. In this embodiment, the leg member end is capped with a finial 45 having an enlarged base 46 with a generally cylindrical nipple-like member 47 upstanding from the base. The finial is sized such that a grommet-type of fastening means 23 may be slipped over member 47 to rest upon base 46. Whatever form the leg member termination takes, it must cooperate with fastening means 23 to secure means 23 at the leg member top and to thereby hold the hamper bag upright. When the hamper bag is full, one may simply unfasten means 21 and 23, lift the bag from the frame, and carry it to the laundry.

Figure 9:
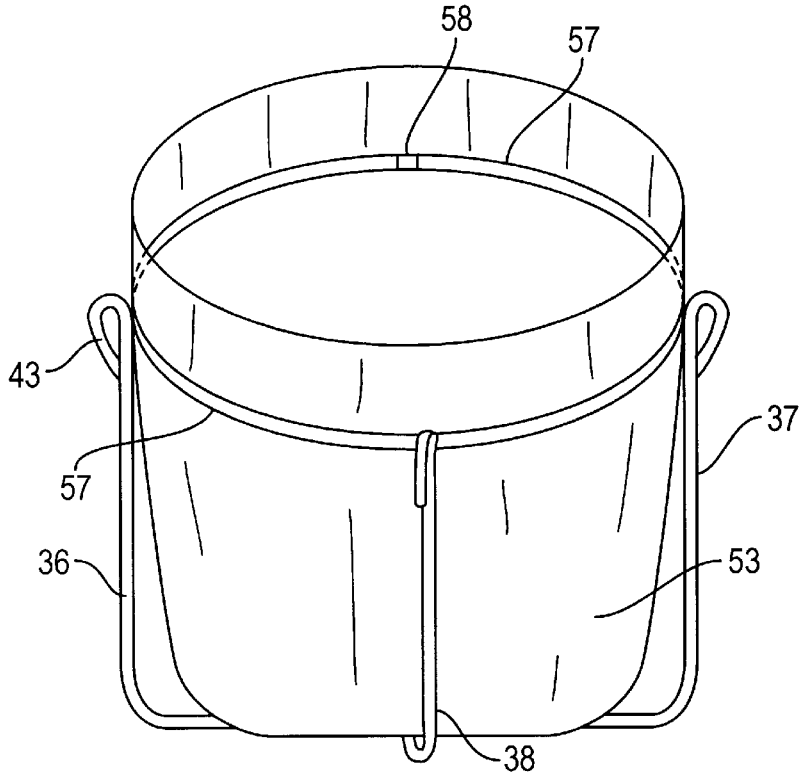
FIG. 9 is a perspective view of another embodiment of the hamper bag and frame of FIG. 1 that is especially adapted for use as a magazine holder or waste basket.
Figure 10:
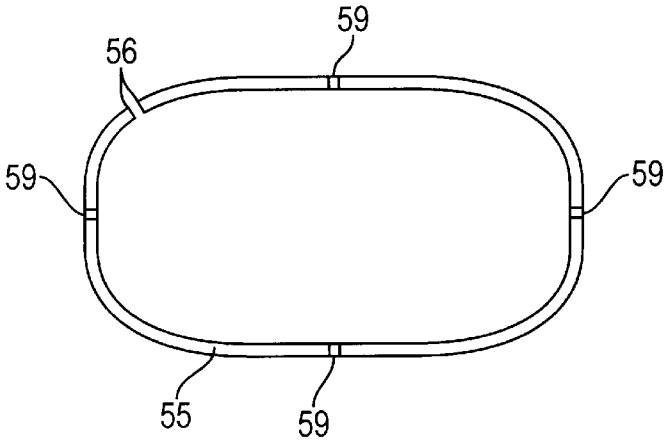
FIG. 10 is a plan view of the stiffening member of FIG. 9.

FIG. 9 depicts an embodiment of the hamper bag that is particularly adapted for use as a waste basket or magazine holder. In this embodiment, hamper bag 53 is arranged with an open top and is provided with a stiffening member 55 (FIG. 10) that is secured around the perimeter of the bag to hold the top open. Stiffening member 55 may comprise a plastic or metal rod, suitably brass, that is bent to the desired shape of the bag top leaving the member ends 56 closely spaced and aligned but not joined. Hamper bag 53 is provided with a sewn channel 57 that is located at the height of the frame legs. Channel 57 is arranged with four eyelets 58 which align with the four frame legs, and align as well with holes 59 drilled through member 55.

Figure 11:
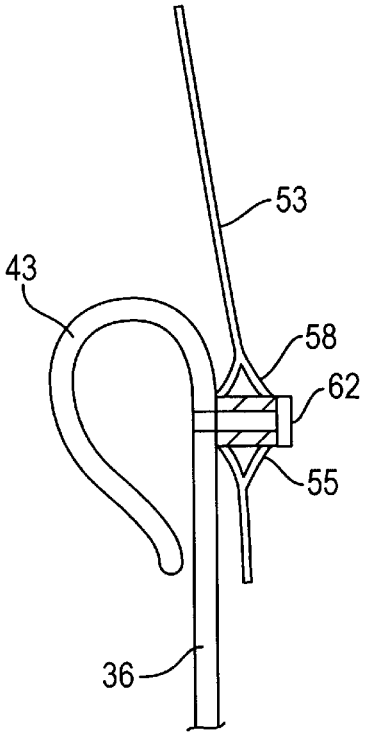
FIG. 11 is a detail view in partial section of a frame leg member showing means for securing the hamper bag and its stiffening member to the frame.

Member 55 is guided into channel 57 through one of the eyelets 58 and is positioned such that holes 59 in member 55 are in alignment with the eyelets. Bag 53 is then positioned within the frame and oriented so that the eyelets align with the frame legs. As is shown in FIG. 11, member 55 and bag 53 are secured to a frame leg member at each eyelet location by a fastener 62, suitably a screw, that passes through a hole 59 in member 55 and threadably seats in a frame leg member to hold the bag securely within the frame.

As may now be appreciated, this invention provides a hamper to store laundry or other objects that is both stylish and utilitarian. It is simple in construction, and allows for almost infinite variation in the look that can be obtained, thus lending style and elegance to any setting.

While preferred embodiments of the invention have been presented for purposes of illustration and description, that disclosure is not intended to be exhaustive, nor to limit the invention to the precise forms disclosed. Other variations and modifications to the invention will be apparent to those skilled in the art after study of the foregoing disclosure.

The embodiments of the invention in which exclusive rights are asserted are set out in the following claims.

I claim:

1. A frame and hamper bag, comprising:

a frame for supporting said hamper bag in a secure and upright position, said frame comprising a base and four equi-length leg members, said leg members fixed to said base and disposed vertically, parallel one to another, the top of each leg member adapted to secure a detachable fastening means thereto; and a bag arranged for the storage of objects therein, said bag having a flat, rectangular bottom and vertical sides, said bag having first detachable fastening means extending from each intersection of two bag sides adjacent the bag bottom to a neighboring leg member for securing said bag to said frame, and second detachable fastening means disposed near the bag top and extending from each intersection of two bag sides to the top of a neighboring leg member, and arranged to hold the bag upright within said frame.

2. The frame and hamper bag of claim 1 wherein said frame is constructed from a pair of U-shaped elements, each said element having a base member and two vertically extending leg members, the element base members joined together at the mid-points thereof.

3. The frame and hamper bag of claim 2 wherein said U-shaped frame elements are symmetrical one to the other.

4. The frame and hamper bag of claim 1 wherein the hamper bag is constructed from four rectangular panels, each said panel having a top end, a bottom end and two sides, the bottom end of said panel sewn to the bag bottom, and the sides of adjacent panels sewn together.

5. The frame and hamper bag of claim 4 wherein the top edge of each said panel is turned and sewn to form a channel through which a drawstring is passed.

6. The frame and hamper bag of claim 1 wherein said first fastening means comprise webbing adapted to be secured around a frame leg member.

7. The frame and hamper bag of claim 1 wherein said leg members are fabricated from metal strapping, and wherein the top of each leg member is rebent downwardly to form a loop.

8. The frame and hamper bag of claim 7 wherein said second fastening means comprise a length of webbing that is arranged to pass through said loop and secure said bag to the leg member.

9. The frame and hamper bag of claim 1 wherein said leg members are fabricated from metal tubing, and wherein the top of each leg member is capped with a finial.

10. The frame and hamper bag of claim 9 wherein said finial is formed with an enlarged base having an upstanding nipple-like member upstanding therefrom.

11. The frame and hamper bag of claim 10 wherein said second fastening means comprise a grommet member that is adapted to slip over said nipple-like member and rest upon said base.

12. The frame and hamper bag of claim 11 wherein said second fastening means is positioned at a location below the bag top approximately half the distance between adjacent leg members.

13. The frame and hamper bag of claim 1 wherein the front and sides of the hamper bag are formed as panels that are identical in size and shape, and wherein the rear of the hamper bag is formed as a panel that is extended in length to fold over the bag top and form a closure therefor.

14. The frame and hamper bag of claim 1 wherein said frame includes a rectangular base member having four vertically upstanding leg members, one leg member attached at each base corner.

15. The frame and hamper bag of claim 1 wherein the top of said hamper bag is held open by means of a stiffening member secured around the perimeter of said bag and adjacent to said open bag top.

16. A frame and hamper bag, comprising:

a frame for supporting said hamper bag in a secure and upright position, said frame comprising a base and four equi-length leg members, said leg members fixed to said base and disposed vertically, parallel one to another, the top of each leg member adapted to secure a detachable fastening means thereto; and a bag arranged for the storage of objects therein, said bag having an open top and generally vertical sides and having a stiffening member that comprises a rod bent to the shape of the bag top secured in a channel around the bag perimeter at the height of the frame leg members, said channel having eyelets that are aligned with the frame leg members and arranged to allow insertion of said rod therethrough, said rod detachably secured to the leg members thereby holding the bag upright within the frame.

17. The frame and hamper bag of claim 16 wherein said rod is provided with holes therethrough, said holes aligning with the channel eyelets and with the frame leg members.

18. The frame and hamper bag of claim 17 wherein said rod is secured to the frame leg members by means of screws that pass through the holes in the rod and threadably seat in the frame leg members.

* * * * *